United States Patent [19]

Lajoye

[11] Patent Number: 4,763,717

[45] Date of Patent: Aug. 16, 1988

[54] CENTRIFUGAL METHOD AND APPARATUS FOR MELTING AND CASTING OF METAL ALLOYS

[76] Inventor: Pierre Lajoye, 40 rue Charles de Gaulle, Montigny Les Metz (Moselle), France

[21] Appl. No.: 484,355

[22] Filed: Apr. 18, 1983

Related U.S. Application Data

[63] Continuation of Ser. No. 645,976, Jan. 2, 1976, abandoned.

[30] Foreign Application Priority Data

Jan. 2, 1975 [FR] France ..... 75 00604

[51] Int. Cl.[4] ..... B22D 13/04; B22D 18/06

[52] U.S. Cl. ..... 164/258; 164/286

[58] Field of Search ..... 164/114, 286, 303, 306, 164/254, 256, 258, 61, 62

[56] References Cited

U.S. PATENT DOCUMENTS

| | | | |
|---|---|---|---|
| 1,703,739 | 2/1929 | Klepsch | 164/62 |
| 2,450,755 | 10/1948 | Higgins | 164/114 |
| 2,952,056 | 9/1960 | Shuck | 164/258 X |
| 2,997,756 | 8/1961 | Strom | 164/256 X |
| 3,700,026 | 10/1972 | Adachi et al. | 164/256 |
| 3,863,706 | 2/1975 | Chandley et al. | 164/62 X |

FOREIGN PATENT DOCUMENTS

| | | | |
|---|---|---|---|
| 6905546 | 9/1970 | Netherlands | 164/254 |
| 855667 | 12/1960 | United Kingdom | 164/254 |
| 1171295 | 11/1969 | United Kingdom | 164/119 |
| 240192 | 8/1969 | U.S.S.R. | 164/258 |
| 387784 | 10/1973 | U.S.S.R. | 164/258 |

*Primary Examiner*—Kuang Y. Lin

*Attorney, Agent, or Firm*—Remy J. VanOphem

[57] ABSTRACT

A method for melting and casting of metals and alloys and an apparatus using the method. The method consists of utilizing a compact assembly for melting and centrifugal casting of metals. The assembly includes a mold or chiller which is rotatable around a vertical axis. The mold communicates with a sealed lower housing containing an oven for the melting of the metal. The assembly is such that the interior chambers of both the oven and the mold are positioned in a vacuum during the entire time of the process of melting of the metal contained in the oven. The oven is movable vertically and is maintained in a position such that the lower extremity of a hollow vertical channel which feeds the mold, remains outside of the molten metal in the interior cavity of the oven when melting is occurring. Thus, the melting is accomplished entirely in a vacuum condition, thereby avoiding the formation of oxides or other chemical compounds.

2 Claims, 4 Drawing Sheets

CENTRIFUGAL METHOD AND APPARATUS FOR MELTING AND CASTING OF METAL ALLOYS

CROSS REFERENCE TO RELATED APPLICATIONS

The present invention is a continuation application of copending prior United States application Ser. No. 645,976, filed Jan. 2, 1976, now abandoned, which claims priority of French Patent Application No. 75 00 604 filed Feb. 1, 1975.

BACKGROUND OF THE INVENTION

The present invention relates to a method and an apparatus for melting and casting metals, including elemental metals and metallic alloys, under vacuum conditions. The present invention is applicable especially to metals having a great tendency to oxidize.

Applicant's French Pat. No. 1,587,403 describes a method for centrifugal casting which allows the avoidance of the appearance of "porosity" following the fill-up of the mold for members having a circular cross-section.

Applicant's French Patent Application, filed on Aug. 25, 1969, under Ser. No. 69 28 972 describes a method which permits heating the central cavity of a mold during centrifugal casting. Using this method, the metal is maintained at a convenient temperature for progressively feeding the "shrinkage holes", which form during the solidification process. The quality of the castings of oxidizable metals is improved by utilizing a permanent degasifier for the mold during the entire casting process.

Accordingly, centrifugal, non-turbulent casting, which is carried out under vacuum conditions using a centrifugal crucible, is generally known. Nevertheless, in the known process, the metal is melted externally of the mold and is then transported to the feeder apparatus of the centrifugal machine.

The present invention has for its object the improvement of the known centrifugal casting method in order to avoid the formation of oxides and other undesired chemical compounds which were previously developed subsequent to the melting process and the flow of the metal into the mold. The present invention has particular application in the molding of readily oxidizable metals which easily combine with other elements.

SUMMARY OF THE INVENTION

The method of the present invention consists of utilizing a compact centrifugal casting assembly for melting and centrifugal casting of metals. As used herein, the term metal includes single element metals as well as metallic alloys. The centrifugal casting assembly includes a mold or chiller which is rotatable around a vertical axis and which communicates with a sealed lower housing containing an oven for the melting of the metal. The assembly is such that the interior cavities of the oven and the mold have a vacuum condition during the entire time of the process of melting of the metal contained in the interior cavity of the oven. The oven is movable vertically towards and away from the lower end of a hollow vertical channel which feeds the mold. The lower end of the hollow vertical channel remains outside of the metallic bath of the oven when the melting process is occurring. In this fashion the melting process is accomplished entirely in a vacuum condition, thereby avoiding the formation of oxides or other chemical compounds. Moreover, with the oven at its bottom position relative to the mold, the mold and the metallic bath of the oven cannot communicate with each other and, therefore, casting does not occur during the period of temperature elevation for carrying out the process of melting the metal.

In accordance with another characteristic of the method of the present invention, when the molten metal has reached the desired casting temperature, the oven is lifted relative to the mold in order that the lower end of the vertical channel which feeds the mold is submerged in the metallic bath contained in the oven. During this time, the oven is maintained at the desired temperature for the centrifugal casting process.

In accordance with another feature of the method of the present invention, the flow rate of the molten metal into the mold is controlled, first when the mold is stationary and then when the mold is rotated. To accomplish this, the discharge of a gas introduced in the housing containing the oven is regulated. Since the centrifugal mold cavity is maintained in a state of vacuum and is fed by a channel extending into the metallic bath of the crucible, it is apparent that the flow rate of the molten metal in this channel will vary according to the following criteria:

(1) the difference in elevation between the relatively higher mold and upper surface of the molten metal in the oven;
(2) the density of the molten metal or alloy; and
(3) the pressure differential between the elevated mold and the sealed lower housing.

By regulating the discharge of gas into the sealed lower housing, the flow rate of molten metal from the oven to the centrifugal mold can be modulated. In particular, this permits modulation to progressively feed the casting during the cooling and solidification process and, further, to feed the shrinkage holes, which have a tendency to form in the casting during the process of cooling and solidification.

In accordance with a further feature of the method of the present invention, the quality of the casting can be improved by submitting the mold to a continuous degasification during the entire casting operation. In particular, this is done to substantially reduce the pressure in the mold to a level below the saturated vapor pressure of the metal or alloy caused by the elevated temperature of the casting.

The method of the present invention is especially designed for the creation of annular or cylindrical members made of easily oxidizable metals which cannot be cast in the presence of air. Examples of such metals are titanium, magnesium and their alloys.

In the apparatus for carrying out the method of the present invention, as previously mentioned, there is a need to utilize a sealed enclosure or lower housing containing an oven which is movable along a vertical axis to either an upper or lower position. Above this lower housing is disposed a centrifugal mold assembly including a mold and a vertical feed channel located on the axis of rotation of the mold and leading into the interior chamber of the oven. The lack of possible communication except through the vertical feed channel, between the fixed lower housing and the rotatable centrifugal mold assembly of the centrifugal casting apparatus is assured by a first rotatable sealing coupling disposed on top of the lower housing. The desgasification of the mold during the centrifugal casting operation is assured by a second rotatable sealing coupling.

The gas introduced into the housing when the channel is immersed into the metallic bath of the crucible is generally a chemically inert gas.

In accordance with another optional feature of the apparatus of the present invention, the imperviousness of the rotatable sealing coupling between the lower housing and the vertical feed channel, when rotation is desired, is assured by a suitable securing device. The securing device includes a sealed upper chamber disposed externally to the housing between the first and a third rotatable sealing coupling. The impervious chamber is filled with a pressurized chemically inert gas such that if the first rotatable sealing coupling leaks, then only a certain quantity of this pressurized chemically inert gas would enter into the internal housing oven which is maintained under vacuum conditions.

DETAILED DESCRIPTION OF THE PREFERRED EMBODIMENT

Figure 1:
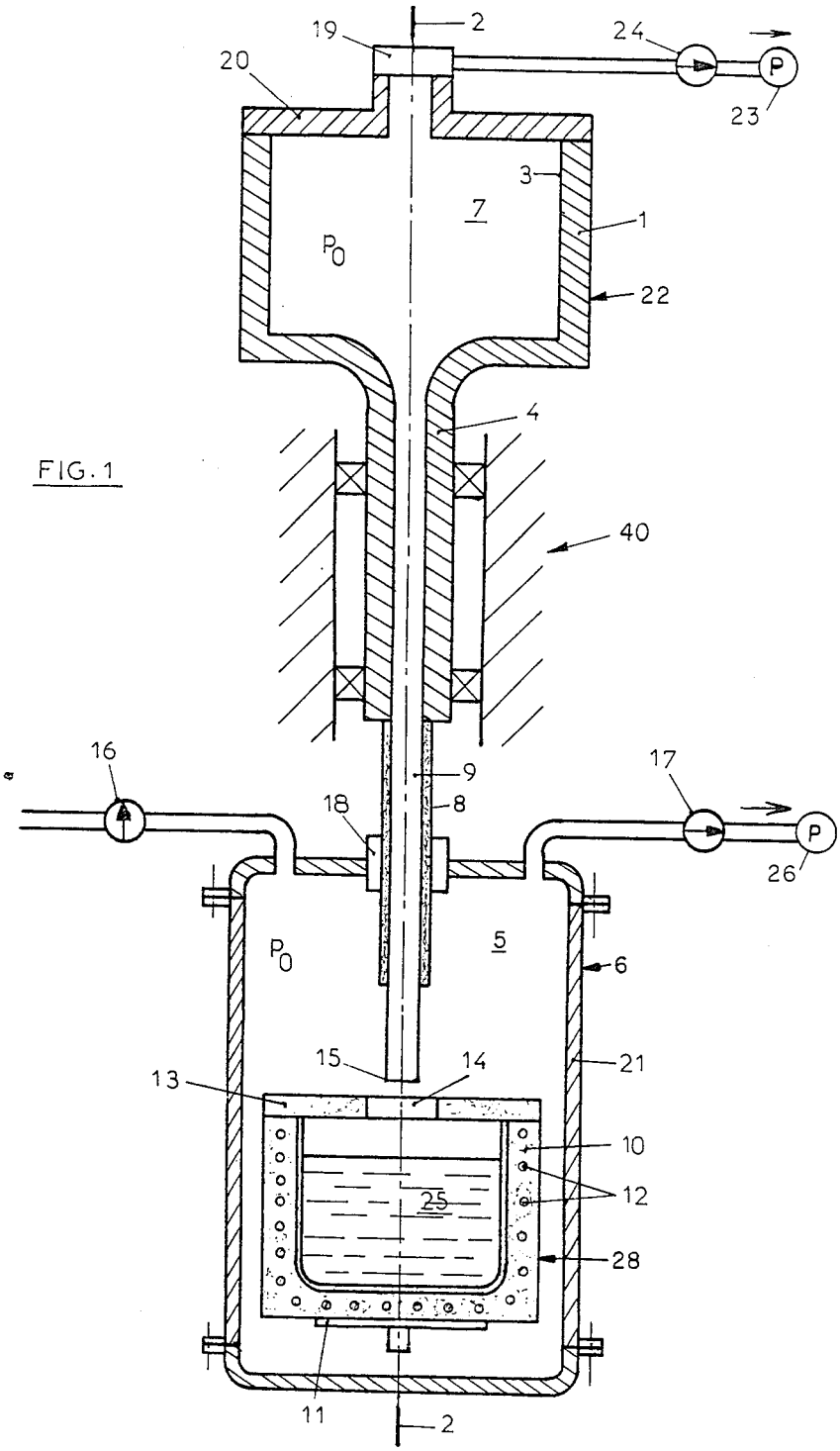
FIG. 1 is a sectional view through an apparatus according to the present invention to melt a metal in a vacuum, and showing the oven in a lowered position.
Figure 2:
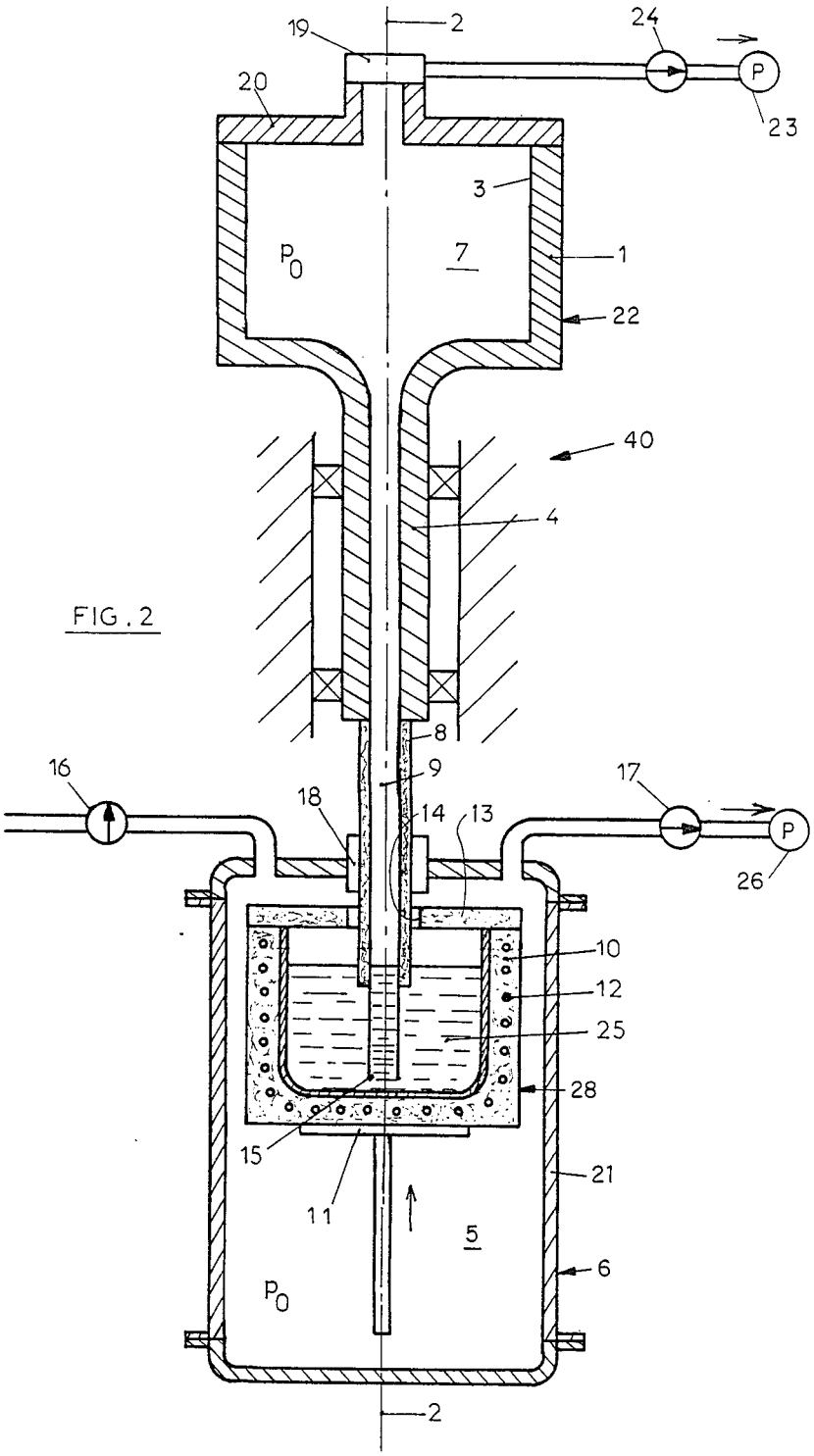
FIG. 2 is a sectional view similar to FIG. 1, and showing the oven in an elevated position.
Figure 3:
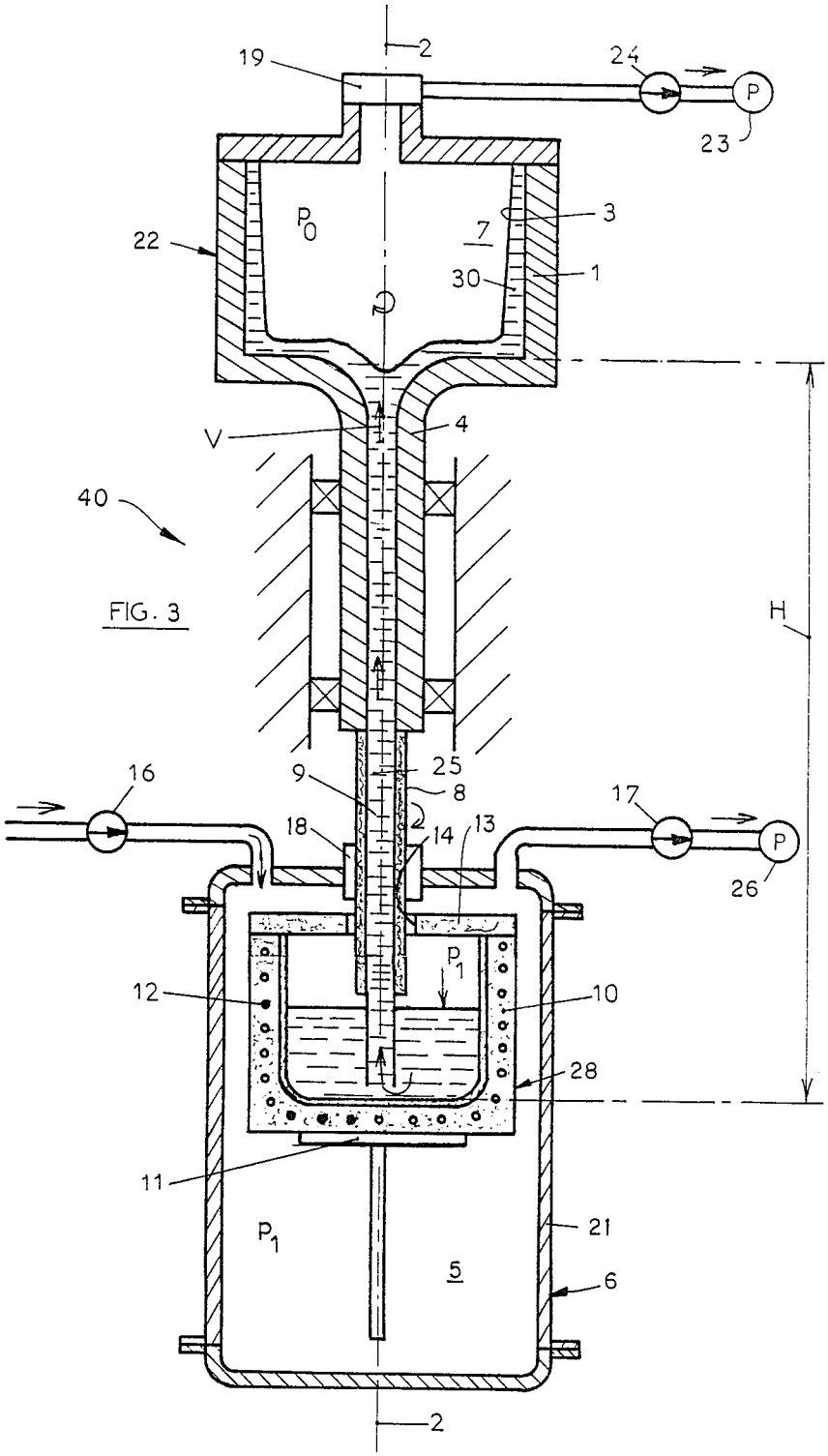
FIG. 3 is a sectional view similar to FIGS. 1 and 2 and illustrates the method in accordance with the present invention for the centrifugal casting of a tubular member.

Referring to the drawing and more particularly to FIGS. 1 through 3, a centrifugal casting apparatus 40 according to the present invention is illustrated. The centrifugal casting apparatus 40 includes a vertical mold or chiller 1 which can be selectively rotated by known means around a vertical axis 2. The interior cylindrical wall 3 of the vertical mold defines an upper chamber 7. A hollow axial vertical shaft 4 extends under the vertical mold 1 and is fixedly secured thereto. A tube 8 extends coaxially with the hollow axial vertical shaft. The hollow axial vertical shaft 4 and the tube 8 define a feed channel 9 which allows communication between the upper chamber 7 of the vertical mold 1, which may be centrifuged, and a lower housing 6. The lower housing 6 defines a lower chamber 5 which contains an oven 28 including, for example, a crucible 10 made of a refractory material. The crucible 10 is carried by a remotely controlled support 11 which is movable upwardly and downwardly along the vertical axis 2. The crucible 10 is heated by a known heating system, for example, by induction heating means consisting of induction coils 12. The upper portion of the crucible 10 is partially closed by a lid 13 having a central orifice 14 which allows the introduction of the lower-most portion 15 of the feed channel 9 into the oven 28. An inlet valve 16 and an outlet valve 17 allow the creation of a vacuum condition inside of the lower housing 6 or the introduction therein of a gas under controlled pressure.

The centrifugal mold assembly 22 consisting of the hollow axial vertical shaft 4, the feed channel 9 and the vertical mold 1 rotate, whereas the lower housing 6 is fixed. The sealing or imperviousness between the rotatable portion and the fixed portion of the machine is ensured by a first rotatable sealing coupling 18 disposed between a wall 21 of the lower housing 6 and the wall of the feed channel 9. A second rotatable sealing coupling 19, mounted in a lid 20 of the vertical mold 1, is coupled to a vacuum pump 23.

One or more sealed access doors, not illustrated, in the wall 21 of the lower housing 6 allow the introduction of the metal into the crucible 10 of the oven 28. The oven 28 is positioned inside the lower housing 6 during construction thereof. It is vertically displaceable by means of the remotely-controlled support 11 subject to remote control.

The operation of the apparatus of the present invention is as follows:

In the first step, the vertical mold 1 and the hollow axial vertical shaft 4 are fixed. They communicate through the first rotatable sealing coupling 18 with the interior of the lower housing 6, which is open. The metal to be melted is introduced into the lower housing 6 through one of the sealed access doors. The access door is subsequently closed and resealed. The inside of the lower housing 6 is sealed against ambient air. The inlet valve 16, which controls the incoming gas is closed such that a vacuum condition is created inside the lower housing 6 and inside the centrifugal mold chamber which communicate with each other by opening the outlet valves 17 and/or 24. The outlet valves 17 and 24 are connected to vacuum pumps 26 and 23, respectively. The remotely-controlled support 11 of the crucible 10 is maintained at its lower position in such a fashion that the lower-most portion 15 of the tube 8 finds itself external to the crucible.

When the desired vacuum is obtained, the induction coils 12 of the oven are operated to elevate the temperature of the crucible 10 and to bring about the melting of the metal 25 contained in the crucible. During the entire duration of the melting operation under vacuum conditions, the vacuum pumps connected to the outlet valves 17 and/or 24 continue to function, while the remotely-controlled support 11 is maintained at is lowered position, as shown in FIG. 1. In this first step, only the melting under vacuum conditions of the metal 25 is accomplished, the metal not being in communication with the feed channel 9 of the mold.

In the second step, when the metal 25 has reached its desired casting temperature, the crucible 10 containing the metal bath is lifted by elevating the remotely-controlled support 11 along a vertical guide (not shown). The lower-most portion 15 of the feed channel 9 then becomes submerged in the molten metal 25, as shown in FIG. 2.

The inlet valve 16 is opened so as to feed a gas that fills the inner volume of the lower housing 6. The vertical mold 1 is maintained under vacuum conditions, that is, under a minimal pressure $p_0$ less than the ambient atmospheric pressure. The introduction of a gas through the inlet valve 16 increases the pressure level inside the lower housing 6 to a value $p_1$ greater than $p_0$. The pressure difference $(p_1-p_0)$ forces the molten metal 25 upwardly along the feed channel 9 into the upper chamber 7 of the vertical mold 1. A bottom-fed casting is thereby produced under vacuum conditions. The vertical mold 1 remains stationary. The metal 25 is maintained in a liquid form both inside the crucible 10 of the oven 28 and in the feed channel 9, which may also be heated by known means, not illustrated.

After the start of the casting operation, the vertical mold 1 is rotated around the vertical axis 2. The rotation of this mold allows the realization, by the process of centrifuging the liquid metal, of a tubular member 30 cast against the interior cylindrical wall 3 of the rotating vertical mold 1, as shown in FIG. 3.

As was earlier described, when a certain quantity of gas was introduced inside the lower housing 6, a pressure differential ($p_1-p_0$) was established between the lower chamber 5 of the lower housing 6 and the upper chamber 7 of the vertical mold 1. It is evident that this pressure differential varies with the flow of gas through the inlet and outlet valves 16, 17 and 24. If one supposes that the gas outflows from the outlet valves 17 and 24 remain constant, the speed of elevation of the metal by way of the feed channel 9 will become a function of the inflow rate of gas through the inlet valve 16. This inflow rate can be regulated in order to control the supply of metal to the tubular member 30 being centrifugally cast. In particular, near the end of the casting process, the shrinkage holes which form during the process of cooling and solidification of the tubular member 30 are progressively fed, especially for certain alloys or for certain temperature intervals during the solidification process.

The pressure differential required between the lower chamber 5 of the lower housing 6 and the upper chamber 7 of the vertical mold 1 for the same speed with upward movement of different metals, or for system components of different relative heights, increases with the density of the metal to be cast, and with the vertical distance separating the upper surface of the molten metal 25 inside of the oven 28 from the vertical mold 1.

Figure 5:
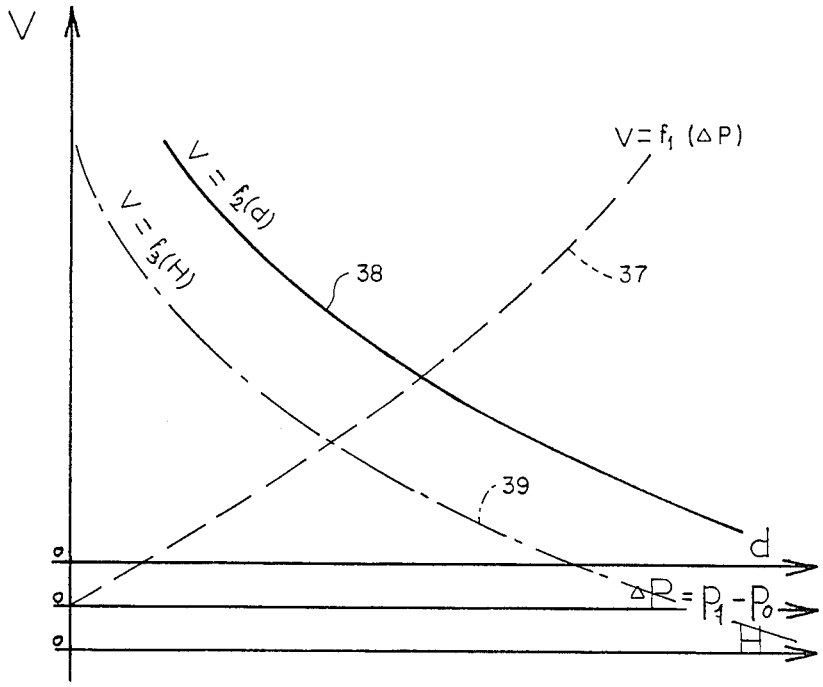
FIG. 5 is a graph illustrating the modulation of the flow rate of metal into the mold by varying the rate of discharge of a gas into the oven housing, according to the method of the present invention.

FIG. 5 shows three curves each indicating the variation of flow rate V of the molten metal 25 as a function of a different single variable. Thus the curve 37 shows the variation of the flow rate V with the pressure differential $\Delta P$ between the gas pressure $p_1$ inside the lower chamber 5 of the lower housing 6 and the gas pressure $p_0$ in the upper chamber 7 of the vertical mold 1. The curves 38 and 39 respectively show the variation of the flow rate V with the density d of the metal and with the difference in elevation or pressure gradient H between the vertical mold 1 and the lower housing, as depicted in FIG. 3.

Since the upper chamber 7 of the vertical mold 1 is sealed, it suffices in principle to control the vacuum only with operation of the outlet valve 17. Thus, in a simplified construction, the second rotatable sealing coupling 19 and the outlet valve 24 can be eliminated. The operation nevertheless would remain the same as previously described.

Thus, the centrifugal casting under vacuum conditions is accomplished by ensuring that the lowermost portion 15 of the feed channel 9 constantly remains submerged in the molten metal 25 contained inside the unemptied crucible 10 of the oven 28.

Figure 4:
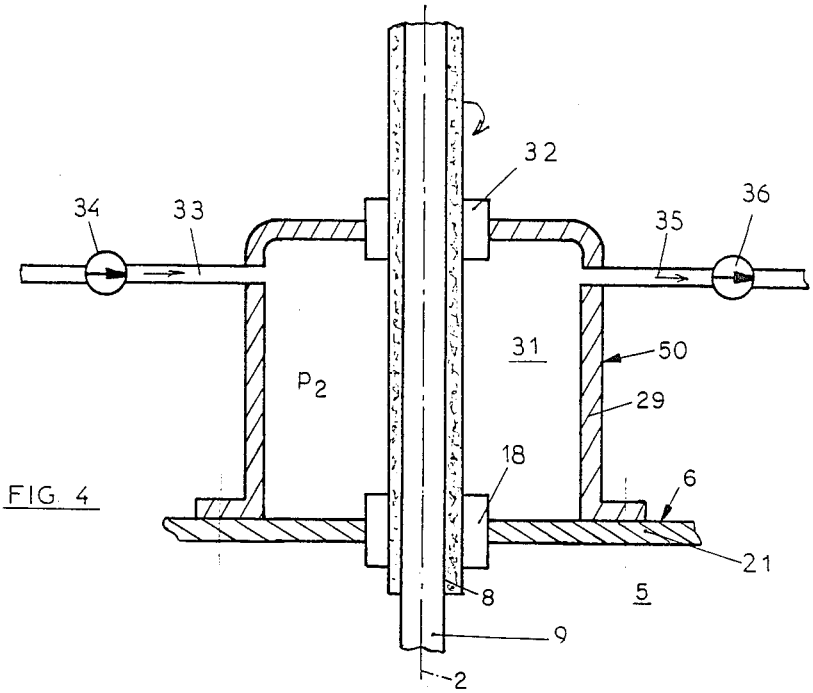
FIG. 4 is a partial sectional view of sealing means to establish a seal between the lower housing, which is fixed, and the centrifugal mold assembly, which is rotatable.

Nevertheless, the second rotatable sealing coupling 19 and the outlet valve 24 allow reducing the ambient pressure in the upper chamber 7 to a pressure level below the saturated vapor pressure of the metal 25 at the temperature of casting. An example of a sealing means 50 for protection against air leaks through the first rotatable sealing coupling 18 is represented in FIG. 4. This construction, which is considerably elaborated, is designed particularly for the casting of titanium and its alloys, which cannot be permitted to be molten in the presence of air. The sealing means has an upper housing 29 mounted to the wall 21 of the lower housing 6 to form a sealed intermediate chamber 31 disposed between the first rotatable sealing coupling 18 and a supplementary rotatable sealing coupling 32. The sealed intermediate chamber 31 is provided with an inlet port 33 controlled by a valve 34 and by an outlet port 35 controlled by a valve 36. The sealed intermediate chamber 31 is filled to a pressure $P_2$, with a gas which is unreactive relative to the metal 25. The melting and the centrifugal casting operations are identical to those previously described.

The sealing means 50 operates as follows. If the first rotatable sealing coupling 18 presents a leak, only the unreactive or inert gas contained inside the sealed intermediate chamber 31 will penetrate into the lower chamber 5 of the lower housing 6, from which it is then evacuated through the outlet valve 17. If both the first rotatable sealing coupling and the supplementary rotatable sealing coupling 32 leak simultaneously, the gaseous mixture which penetrates inside the lower chamber 5 of the lower housing 6 would be composed of an unreactive or inert gas containing only a small percentage of air.

What is claimed is:

1. An apparatus for the centrifugal casting of a metal, said apparatus comprising:

rotatable mold means having a central axis, said central axis being vertically disposed, said rotatable mold means further having an upper end and a lower end;

hollow shaft means formed at said lower end of said rotatable mold means and extending downwardly therefrom along said central axis;

a mold cavity formed in said rotatable mold means, said mold cavity being sealed;

a central passage formed in said hollow shaft means, said central passage having an upper end communicating with said mold cavity and a lower end remote from said upper end, said central passage extending downwardly along said central axis from said upper end to said lower end;

mold rotation means for selectively rotating said rotatable mold means about said central axis;

oven housing means disposed below said rotatable mold means for melting a quantity of metal introduced therein;

intermediate housing means disposed between said rotatable mold means and said oven housing means;

an oven cavity formed in said oven housing means, said oven cavity being sealed;

crucible means disposed within said oven cavity, such that a quantity of said metal to be melted may be placed in said crucible means, said crucible means being in communication with said oven cavity;

heating means, for heating said crucible means to thereby melt said quantity of metal to form molten metal;

first aperture means in said oven housing means, said first aperture means extending from said oven cavity to a location external of said oven housing means;

tube means interposed said hollow shaft means of said rotatable mold means and said oven housing means, said tube means having an upper end, a lower end opposite said upper end, and a channel means extending from said upper end to said lower end, said upper end of said tube means being interconnected with said hollow shaft means such that said channel means is in communication with said central passage, said lower end of said tube means being passed through said first aperture means in said oven housing means into said oven cavity, said lower end of said tube being disposed above said crucible means;

first rotatable sealing coupling means interposed said lower end of said tube means and said oven housing means, said first rotatable sealing coupling means forming a seal between said lower end of said tube means and said oven housing means to close said first aperture means, said first rotatable sealing coupling means further permitting said tube means to rotate relative to said oven housing means about said central axis when said mold rotation means is actuated to rotate said rotatable mold means;

a sealed chamber formed between said intermediate housing means and said oven housing means such that said sealed chamber surrounds a portion of said lower end of said tube means, said sealed chamber further surrounding said first rotatable sealing coupling means;

second aperture means in said intermediate housing means, said lower end of said tube means being passed progressively through said second aperture means, said sealed chamber, and said first aperture means into said oven cavity;

second rotatable sealing coupling means interposed said lower end of said tube means and said intermediate housing means, said second rotatable sealing coupling means forming a seal between said lower end of said tube means and said intermediate housing means to close said second aperture means, said second rotatable sealing coupling means further permitting said tube means to rotate relative to said intermediate housing means about said central axis when said mold rotation means is actuated to rotate said rotatable mold means;

displacement means selectively operable for relatively moving along said central axis, said lower end of said tube means and said crucible means, such as to enable selectively submerging said lower end of said tube means in said molten metal disposed in such crucible means as well as to enable selectively removing said lower end of said tube means for contact with said molten metal, said channel means being thereby selectively placeable in communication with said molten metal in said crucible means, said molten metal forming a liquid seal between said oven cavity and said channel means when said lower end of said tube means is submerged in said molten metal;

first pump means for selectively creating a first predetermined pressure level in each of said mold cavity, said central passage, said channel means and said oven cavity during the heating of said crucible means and prior to submerging said lower end of said tube means into said molten metal such that said mold cavity, said central passage, said channel means and said oven cavity are continuously maintained at said first predetermined pressure level until after said tube means has become submerged in said molten metal, said first predetermined pressure level being a vacuum pressure level, said first pump means being interconnected with said upper end of said rotatable mold means at a location adjacent said central axis such that said first pump means maintains said first predetermined pressure level in each of said mold cavity, said central passage and said channel means after said tube means has become submerged in said molten metal, thereby reducing the amount of vaporized metal in said mold cavity; and second pump means for controllably introducing a quantity of a chemically inert pressurized gas into said oven cavity after said lower end of said tube means is submerged into said molten metal in said crucible means, said chemically inert pressurized gas being pressurized to a second predetermined pressure level, said second predetermined pressure level being greater than said first predetermined pressure level such that a pressure differential exists between said oven cavity and said mold cavity, said molten metal being advanced from said crucible means to said mold cavity along said channel means and said central passage by said pressure differential, said mold rotation means thereafter being actuated to disperse said molten metal centrifugally in said mold cavity such that said molten metal is forced under pressure into said mold cavity while said rotatable mold means is rotated to thereby form a centrifugal casting in said mold cavity;

said chemically inert gas being disposed in said oven cavity such that the quantity of ambient air passing through an leaks developed in said first rotatable sealing coupling means at the point whereat said tube means extends into said oven housing means, is minimized.

2. The apparatus of claim 1 further comprising valve means interposed said second pump means and said oven cavity for progressively varying the flow rate of said molten metal from said crucible means to said mold cavity during formation of said centrifugal casting to thereby feed shrinkage holes forming in said centrifugal casting as it cools.

* * * * *

UNITED STATES PATENT AND TRADEMARK OFFICE

CERTIFICATE OF CORRECTION

PATENT NO. : 4,763,717

DATED : August 16, 1988

INVENTOR(S) : Pierre LaJoye

It is certified that error appears in the above-identified patent and that said Letters Patent is hereby corrected as shown below:

Column 2, line 68, delete "desgasification" and insert ---- degasification ----.

Signed and Sealed this

Twenty-first Day of March, 1989

*Attest:*

*Attesting Officer*

DONALD J. QUIGG

*Commissioner of Patents and Trademarks*